US006379160B1

(12) United States Patent
Loman

(10) Patent No.: US 6,379,160 B1
(45) Date of Patent: Apr. 30, 2002

(54) METAL PLATE MOUNTED TO CONNECTOR AND METHOD FOR MANUFACTURING THE SAME

(75) Inventor: Martinus Hendricus Loman, Oss (NL)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/712,351

(22) Filed: Nov. 14, 2000

(30) Foreign Application Priority Data

Nov. 15, 1999 (NL) ..... 1013575

(51) Int. Cl.[7] ..... H01R 12/00
(52) U.S. Cl. ..... 439/79; 439/545
(58) Field of Search ..... 439/577, 571, 439/79, 545, 562, 555, 569, 331

(56) References Cited

U.S. PATENT DOCUMENTS 4,166,665 A * 9/1979 Cutchaw ..... 439/196
4,768,973 A * 9/1988 Bakermans ..... 439/331
4,948,374 A * 8/1990 Carter ..... 439/67
5,716,226 A 2/1998 Takahashi et al. ..... 439/329
6,062,911 A * 5/2000 Davis et al. ..... 439/630

FOREIGN PATENT DOCUMENTS

| | | |
|---|---|---|
| EP | 0338717 A2 | 10/1989 |
| EP | 0930812 A2 | 7/1999 |
| WO | WO 98/34298 | 8/1998 |

* cited by examiner

*Primary Examiner*—Gary Paumen
*Assistant Examiner*—James R. Harvey
(74) *Attorney, Agent, or Firm*—Perman & Green, LLP

(57) ABSTRACT

A connector comprises a housing of insulating material and a metal plate attached to a surface of the housing. This surface is provided with a plurality of pegs of insulating material and the metal plate is provided with a plurality of fixation holes co-operating with the pegs to attach the metal plate to the housing. The passage of each fixation hole of the plate is smaller than the cross-section of the corresponding peg of the housing. The plate is further provided with an entrance hole for each fixation hole. This entrance hole debouches into the fixation hole and has a passage larger than the cross-section of the corresponding peg. The connector is manufactured in that the metal plate is placed on said surface with the entrance holes receiving the pegs with play, whereafter the metal plate is moved along the surface such that the pegs are forced into the fixation holes.

5 Claims, 3 Drawing Sheets

METAL PLATE MOUNTED TO CONNECTOR AND METHOD FOR MANUFACTURING THE SAME

The invention relates to a connector, comprising a housing of insulating material and a metal plate attached to a surface of the housing, wherein said surface is provided with a plurality of pegs of insulating material and said metal plate is provided with a plurality of fixation holes co-operating with said pegs to attach the metal plate to the housing, and to a method for manufacturing such a connector.

EP-A-0 930 812 discloses a connector of this type, wherein the metal plate is fixed on the housing by melting the pegs. The known manner of fixation of the metal plate to the housing is disadvantageous as heating the pegs causes degeneration of the insulation material resulting in an unreliable fixation of the metal plate and/or problems regarding location or fixation of the contact elements accommodated in the housing. Moreover the fixation step in manufacturing the connector is relatively time consuming and involves relatively high production cost.

The invention aims to provide an improved connector of the above-mentioned type.

To this end the connector of the invention is characterized in that the passage of each fixation hole of the plate is smaller than the cross-section of the corresponding peg of the housing, wherein the plate is further provided with an entrance hole for each fixation hole, said entrance hole debouching into the fixation hole and having a passage larger than the cross-section of the corresponding peg.

In this manner a connector is obtained, wherein the metal plate is fixed to the housing without any heating of the insulating material. When the pegs of the housing have been forced from the entrance holes into the fixation holes, narrow grooves will have been formed in the pegs by the metal plate and these grooves co-operate with the area of the metal plate enclosing the fixation holes to hold the metal plate on the surface of the housing. Thereby a reliable fixation is guaranteed.

The invention further provides a method for manufacturing a connector of this type, comprising providing a connector with a housing of insulating material and a metal plate, wherein the metal plate is attached to a surface of the housing by means of a plurality of pegs provided on said surface and fixation holes made in the metal plate, wherein the method of the invention is characterized in that the metal plate is provided with an entrance hole for each fixation hole debauching into the corresponding fixation hole, wherein the entrance holes are made with a size for receiving said pegs with play, and the fixation holes are made with a passage smaller than the cross-section of the pegs, wherein the metal plate is placed on said surface with the entrance holes receiving the pegs with play and the metal plate is moved along said surface such that the pegs are forced into the fixation holes.

In this manner the manufacturing step for fixation of the metal plate to the housing is relatively simple, wherein the metal plate can be fixed to the housing at relatively low manufacturing coast at high manufacturing speed. Moreover, the fixation of the metal plate does not cause any degradation of the insulating material.

The invention will be further explained by reference to the drawings in which an embodiment of the connector of the invention is schematically shown.

Figure 1:
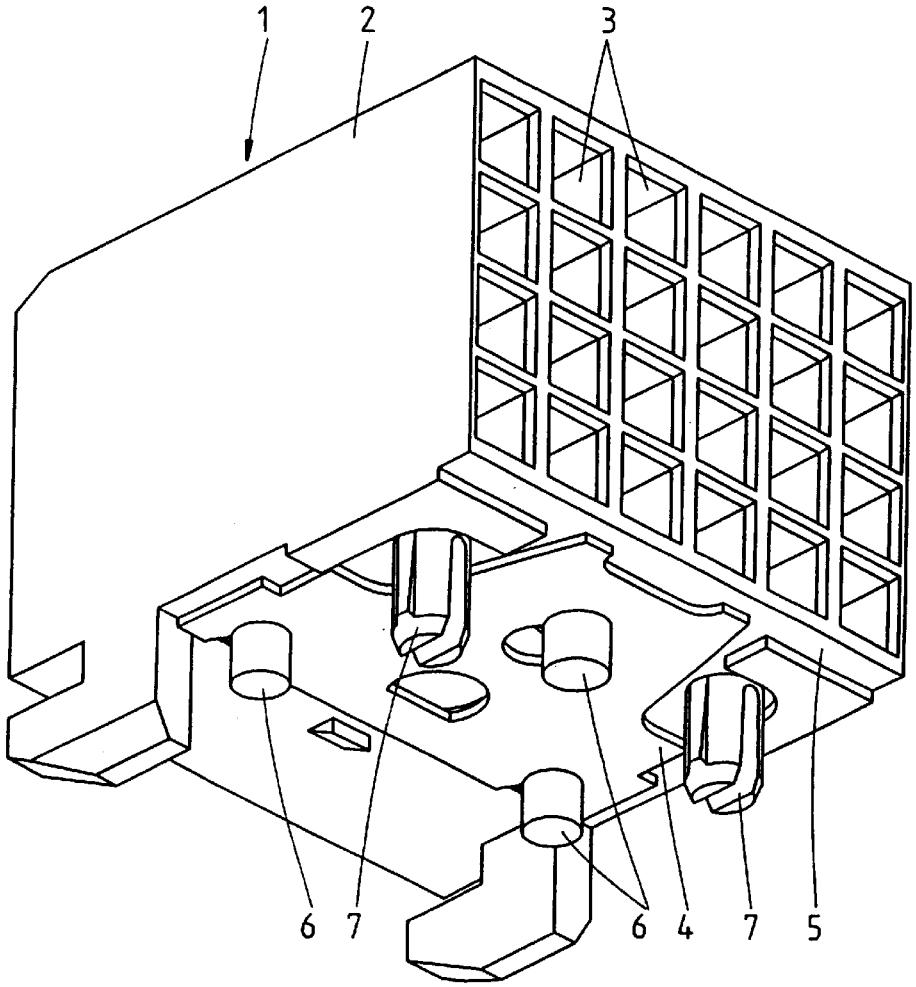
FIG. 1 shows a perspective view of an embodiment of the connector of the invention.

FIG. 1 shows a perspective view of a connector 1 having a housing 2 of insulating material. The housing 2 accommodates a plurality of contact elements not shown arranged in rows and columns in channels 3 provided in the housing 2. The connector 1 is adapted to be mounted on a printed circuit board not shown in a usual manner by a surface mount technique. To this end a metal plate 4 is attached to the bottom surface 5 and this metal plate 4 can be interconnected to the printed circuit board by soldering.

The bottom surface 5 of the housing 2 is provided with three pegs 6 which are integral with the housing 2. Two spring-type pegs 7 are further provided on the bottom surface 5 for holding the connector 1 on the printed circuit board before the solder connection is made.

Figure 2:
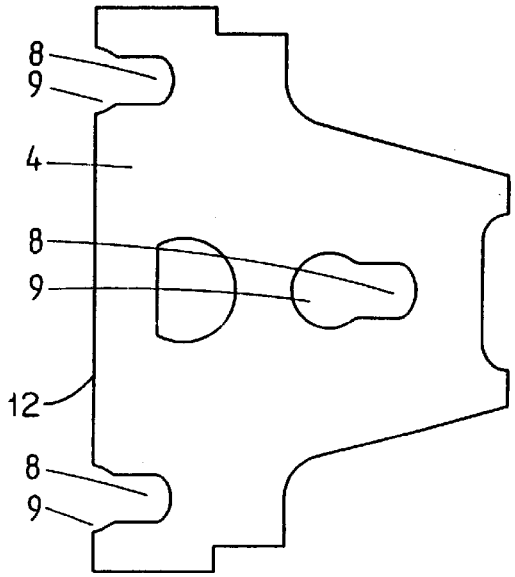
FIG. 2 is a top view of the metal plate of the connector of FIG. 1.

In the embodiment shown the pegs 6 have a circular cross-section. As shown in FIG. 2 the metal plate 4 is provided with fixation holes 8 and entrance holes 9 debauching into the fixation holes 8. The passage of the fixation holes 8 is smaller than the cross-section of the pegs 6, whereas the passage of the entrance holes 9 is larger than the cross-section of the pegs.

Figure 3:
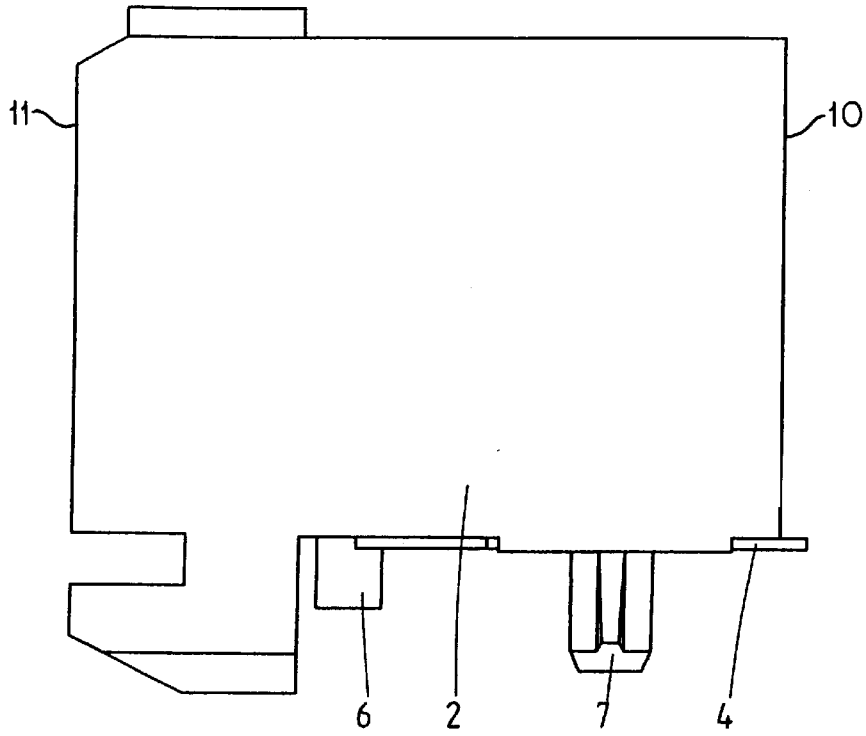
FIGS. 3–6 show side and bottom views of the connector of FIG. 1 to explain the fixation step in the method of the invention.
Figure 4:
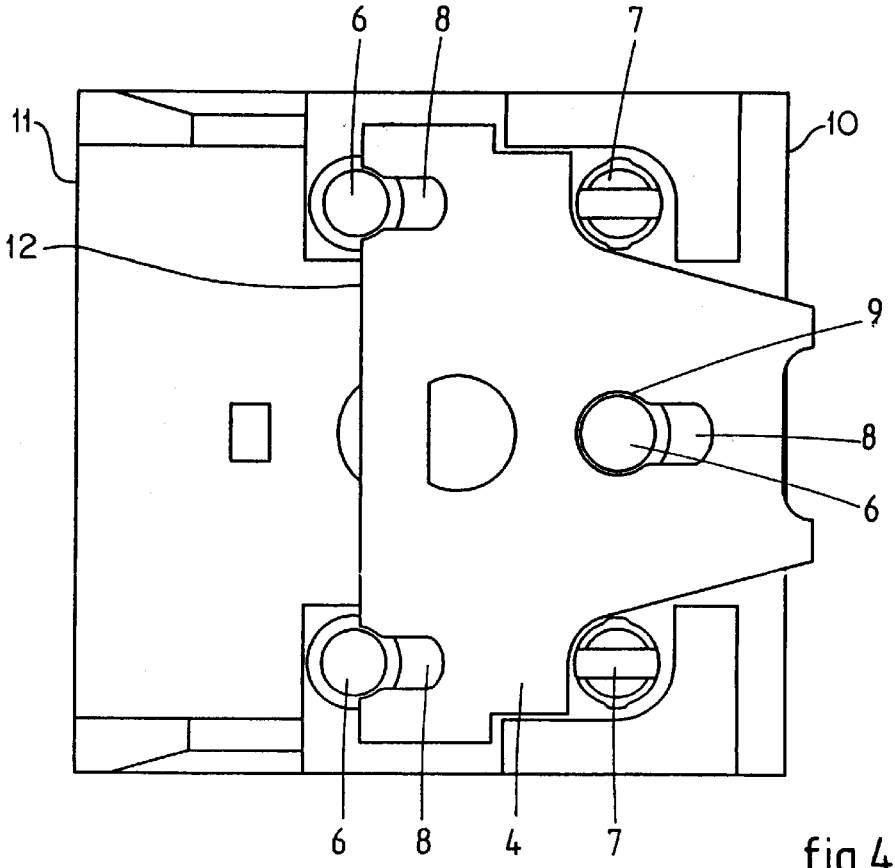

For mounting the metal plate 4 on the housing 2, the metal plate 4 is placed on the bottom surface 5 with the entrance holes 9 receiving the pegs 6 as shown in FIGS. 3 and 4. The movement of the metal plate 4 with respect to the bottom surface 5 is preferably in a direction mainly perpendicular to the bottom surface 5. In view of the sizes of the entrance holes 9 and the pegs 6, the pegs 6 are received with play in the entrance holes 9 so that the pegs are not damaged al all.

Figure 5:
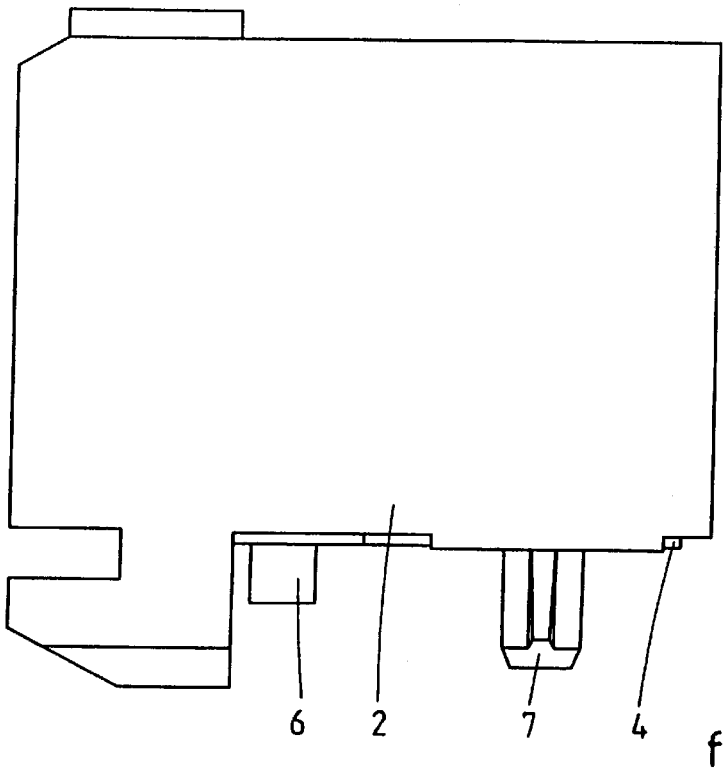
Figure 6:
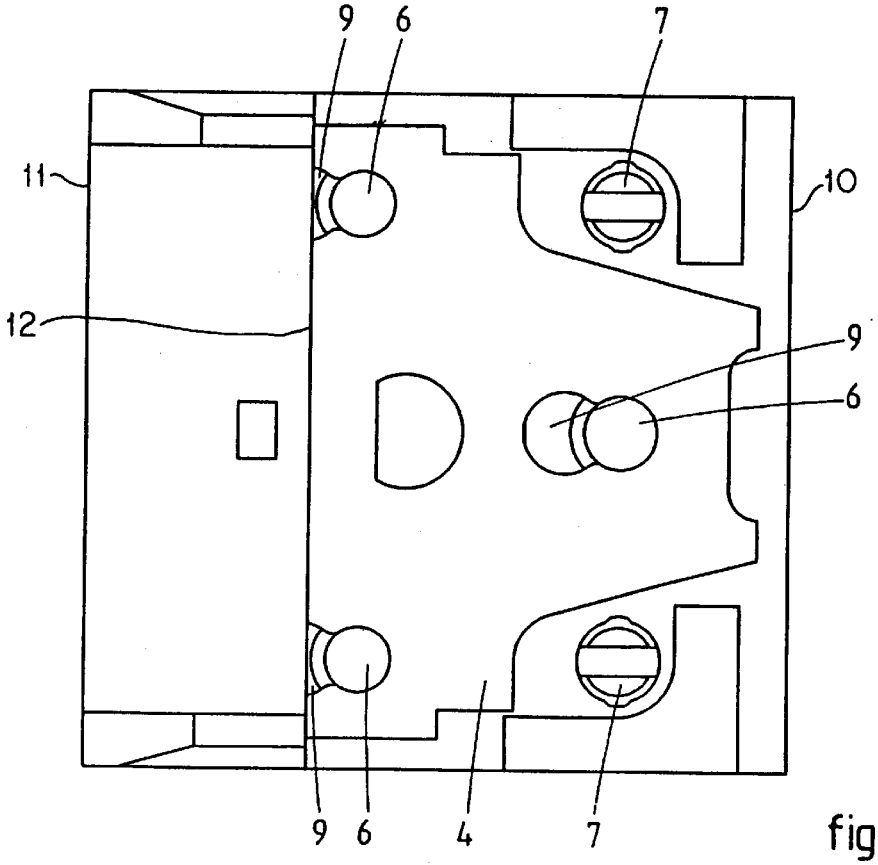

When the metal plate 4 is flush with the bottom surface 5, the metal plate 4 is moved along the bottom surface 5 from the backside 10 of the housing 2 to the front side 11 of the housing during which movement the pegs 6 are forced into the fixation holes 8. At the end of this movement parallel to the bottom surface 5, the position shown in FIGS. 5 and 6 is reached. As the passage of the fixation holes 8 is smaller than the cross-section of the page 6, the metal plate 4 pierces into the material of the pegs 6 forming narrow grooves co-operating with the area of the metal plate enclosing the fixation holes 8 to hold the metal plate 4 on the bottom surface 5.

During the movement of the plate 4 along the bottom surface 5, the plate 4 is preferably pressed against this surface with a predetermined force.

It will be understood that the described manner of fixation of the metal plate 4 on the bottom surface 5 results in a reliable fixation, wherein any degradation of the insulating material of the housing 2 is avoided. The fixation step is relatively simple resulting in a reduction of manufacturing time and cost.

In the embodiment shown, two fixation holes 8 are located near an edge 12 of the metal plate. The entrance holes 9 for these fixation holes 8 are made as a flaring entrance debouching in this edge 12. Therefore, these entrance holes 9 are only a part of a circular hole. It will be understood that the entrance holes 9 for the fixation holes 8 near the edge 12 can be made as a complete circular hole if desired just as the entrance hole 9 near the backside 10 of the housing 2. Of course, different shapes of pegs and entrance and fixation holes can be used as desired.

The invention is not restricted to the above described embodiment which can be varied in a number of ways within the scope of the claims.

What is claimed is:

1. Connector, comprising a housing of insulating material and a metal plate attached to a surface of the housing, wherein said surface is provided with a plurality of pegs of insulating material and said metal plate is provided with a plurality of fixation holes co-operating with said pegs to attach the metal plate to the housing, wherein the passage of each fixation hole of the plate is smaller than the cross-section of the corresponding peg of the housing, wherein the plate is further provided with an entrance hole for each fixation hole, said entrance hole debouching into the fixation hole and having a passage larger than the cross-section of the corresponding peg, and wherein each fixation hole pierces the peg to attach the metal plate to the surface of the housing.

2. Connector according to claim 1, wherein at least one fixation hole is located near an edge of the metal plate, wherein the corresponding entrance hole is made as a flaring entrance debauching in said edge of the metal plate.

3. Method for manufacturing a connector, comprising providing a connector with a housing of insulating material and a metal plate, wherein the metal plate is attached to a surface of the housing by means of a plurality of pegs provided on said surface and fixation holes made in the metal plate, wherein the metal plate is provided with an entrance hole for each fixation hole debauching into the corresponding fixation hole, wherein the entrance holes are made with a size for receiving said pegs with play, and the fixation holes are made with a passage smaller than the cross-section of the pegs, wherein the metal plate is placed on said surface with the entrance holes receiving the pegs with play and the metal plate is moved along said surface such that the pegs are forced into the fixation holes so that each fixation hole pierces the peg to attach the metal plate to the surface of the housing.

4. Method according to claim 3, wherein the metal plate is placed on said surface of the housing in a direction mainly perpendicular to said surface.

5. Method according to claim 3, wherein the metal plate is moved along said surface in a direction parallel to said surface while pressing the plate against said surface.

* * * * *